US008010025B2

(12) United States Patent
Hamakawa et al.

(10) Patent No.: US 8,010,025 B2
(45) Date of Patent: Aug. 30, 2011

(54) DEVELOPING UNIT AND IMAGE FORMING DEVICE

(75) Inventors: Hiroyuki Hamakawa, Shiki-gun (JP); Akihiro Watanabe, Ikoma (JP); Masashi Fujishima, Ikoma (JP); Hiroshi Yamazaki, Kyoto (JP); Asami Kotera, Ibaraki (JP); Sayo Uemura, Amagasaki (JP)

(73) Assignee: Kyocera Mita Corporation (JP)

( * ) Notice: Subject to any disclaimer, the term of this patent is extended or adjusted under 35 U.S.C. 154(b) by 412 days.

(21) Appl. No.: 12/352,094

(22) Filed: Jan. 12, 2009

(65) Prior Publication Data

US 2009/0180818 A1 Jul. 16, 2009

(30) Foreign Application Priority Data

Jan. 15, 2008 (JP) ..... 2008-005936

(51) Int. Cl.
*G03G 15/08* (2006.01)

(52) U.S. Cl. ..... 399/286

(58) Field of Classification Search ..... 399/176, 399/286

See application file for complete search history.

(56) References Cited

U.S. PATENT DOCUMENTS

| | | | | |
|---|---|---|---|---|
| 6,061,539 | A * | 5/2000 | Ishiyama et al. | 399/175 |
| 6,137,986 | A * | 10/2000 | Sugino et al. | 399/333 |
| 6,567,638 | B2 * | 5/2003 | Nakamura et al. | 399/286 |
| 2007/0116493 | A1 * | 5/2007 | Nakamura et al. | 399/176 |

FOREIGN PATENT DOCUMENTS

| | | |
|---|---|---|
| JP | 2004-318092 | 11/2004 |

* cited by examiner

*Primary Examiner* — David M Gray
*Assistant Examiner* — Frederick Wenderoth
(74) *Attorney, Agent, or Firm* — Ostrolenk Faber LLP

(57) ABSTRACT

A developing unit includes a developing roller which rotates about a rotational axis to supply toner to a photoreceptor, the developing roller including: a cylindrical core portion which includes an electric conductor; a first resistive layer which covers a cylindrical surface of the core portion; a second resistive layer which covers the first resistive layer, and has electric-resistivity lower than that of the first resistive layer; and a current leakage control member which prevents leakage of electric current from the core portion toward the second resistive layer through an end of the developing roller along a direction of the rotational axis.

7 Claims, 4 Drawing Sheets

DEVELOPING UNIT AND IMAGE FORMING DEVICE

BACKGROUND OF THE INVENTION

1. Field of the Invention

The present invention relates to a developing unit and an image forming device.

Priority is claimed on Japanese Patent Application No. 2008-005936, filed Jan. 15, 2008, and the content of which is incorporated herein by reference.

2. Description of the Related Art

A known image forming device used for a copier or a printer includes a developing unit for developing an electrostatic latent image formed on a photoreceptor with toner supplied to the photoreceptor. In such a device, the toner is transferred to the photoreceptor from a toner layer formed on a surface of a developing roller. The developing roller is a cylindrical electric conductor provided in the developing unit.

In such an image forming device, voltage is applied to the device to produce a predetermined potential difference between the developer roller and the photoreceptor in order to transfer the toner from the developing roller to the photoreceptor.

However, if the developing roller and the photoreceptor are disposed close to each other with the voltage applied to produce a predetermined potential difference therebetween, leakage of electric current from between the developing roller and the photoreceptor may occur, so that it is difficult to form a toner image which accurately represents the electrostatic latent image on the photoreceptor, and a toner layer on the surface of the developing roller.

Japanese Unexamined Patent Application Publication No. 2004-318092 discloses a method for preventing leakage of electric current from between the developing roller and the photoreceptor by covering a cylindrical surface of the developing roller with an alumite layer (i.e., an aluminum oxide layer).

Alumite, however, has a high electric-resistivity, which may cause excessive charging of the toner due to friction between the toner and the developing roller. This tendency is particularly evident in positively charged toner. As a result, the toner turnover efficiency may become lower.

To address the problem described above, a layer (i.e., a low-resistance layer) made of a material with an electric-resistivity lower than that of alumite may be formed on the alumite layer so as to prevent charge injection into the toner and thus prevent excessive charging of the toner.

If a low-resistance layer is formed on top of the alumite layer, however, electric current may leak into the low-resistance layer from a portion of the electric conductor which forms a core material at an end of the developing roller. The electric current may also leak from the low-resistance layer into the photoreceptor.

The present invention has been made in view of the aforementioned circumstances. Accordingly, it is an object of the present invention to prevent defective toner transfer to the photoreceptor due to excessive charging of the toner. It is another object of the present invention to prevent leakage of electric current between a developing roller and a photoreceptor.

SUMMARY OF THE INVENTION (1) A first aspect of the present invention provides the following: a developing unit including a developing roller which rotates about a rotational axis to supply toner to a photoreceptor, the developing roller including: a cylindrical core portion which includes an electric conductor; a first resistive layer which covers a cylindrical surface of the core portion; a second resistive layer which covers the first resistive layer, and has electric-resistivity lower than that of the first resistive layer; and a current leakage control member which prevents leakage of electric current from the core portion toward the second resistive layer through an end of the developing roller along a direction of the rotational axis.

According to the developing unit, the current leakage control member prevents leakage of electric current from the core portion into the second resistive layer through the end of the developing roller along the direction of the rotational axis. The second resistive layer, having resistivity lower than that of the first resistive layer, prevents charge injection into the toner and thus excessive charging of the toner.

Accordingly, defective toner transfer to the photoreceptor due to excessive charging of the toner can be prevented and leakage of electric current from between the developing roller and the photoreceptor can also be prevented.

(2) The developing unit may be constituted as follows: the current leakage control member is an end of the second resistive layer which is arranged so as to maintain a first distance along the direction of the rotational axis from an end of the first resistive layer.

(3) The developing unit may be constituted as follows: the first distance is longer than a second distance between the surface of the second resistive layer and the photoreceptor.

(4) The developing unit may be constituted as follows: the current leakage control member is a current leakage control layer provided between an end of the first resistive layer and an end of the second resistive layer along the direction of the rotational axis.

(5) The developing unit may be constituted as follows: the current leakage control member is a current leakage control layer provided at an end of the core portion along the direction of the rotational axis.

(6) The developing unit may be constituted as follows: the first resistive layer contains alumite and the second resistive layer contains silicone-modified urethane.

(7) Another aspect of the present invention provides the following: the developing unit develops an electrostatic latent image formed on a photoreceptor with toner supplied to the photoreceptor.

DETAILED DESCRIPTION OF THE INVENTION

Figure 1:
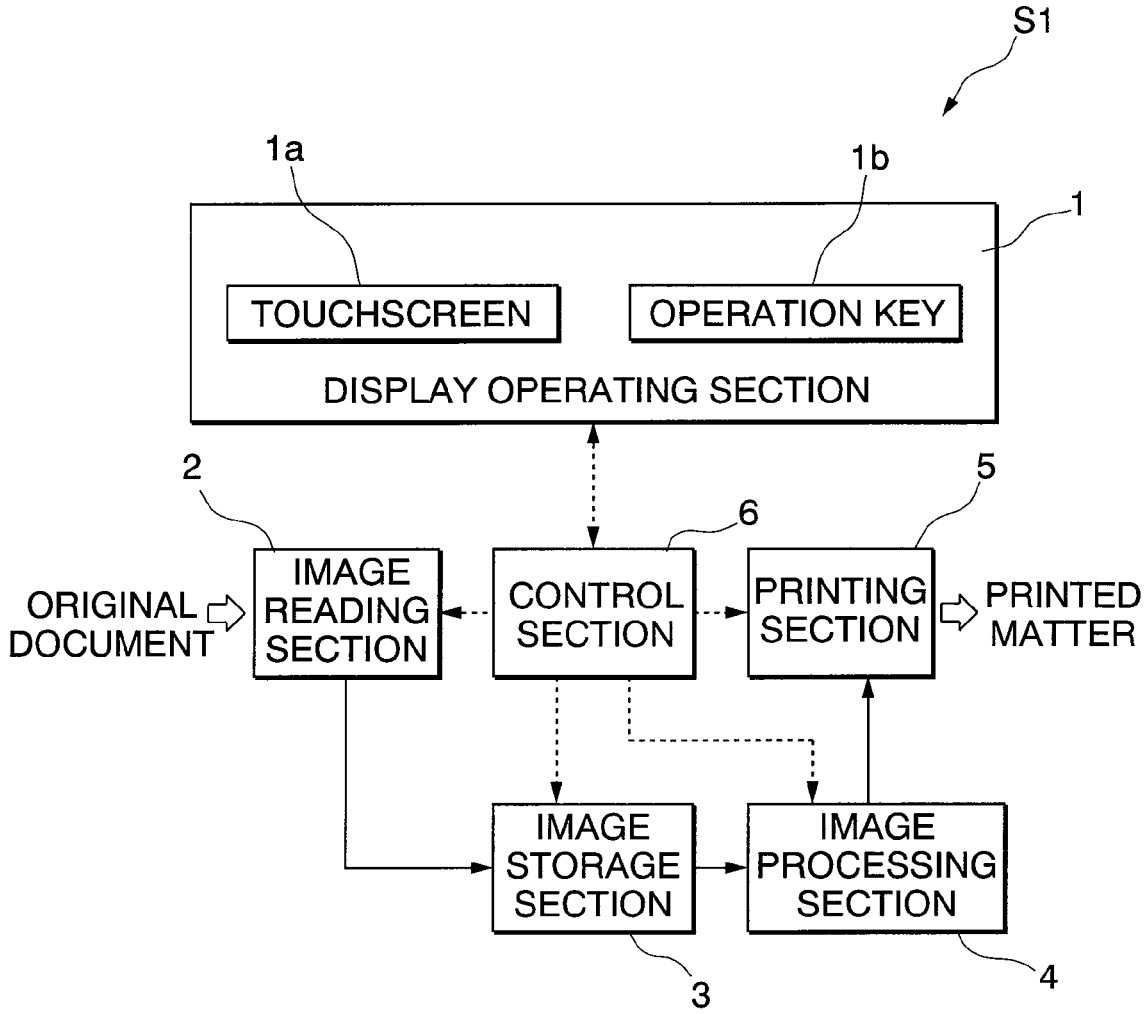
FIG. 1 is a block diagram showing a functional configuration of a copier according to an embodiment of the present invention.

In reference to the drawings, embodiments of the developing unit and the image forming device according to the present invention will be described. In the drawings, the members are not to scale, but are depicted in a visually understandable manner. In the following description, a copier will be illustrated as an example of the image forming device according to the present invention.

Figure 2:
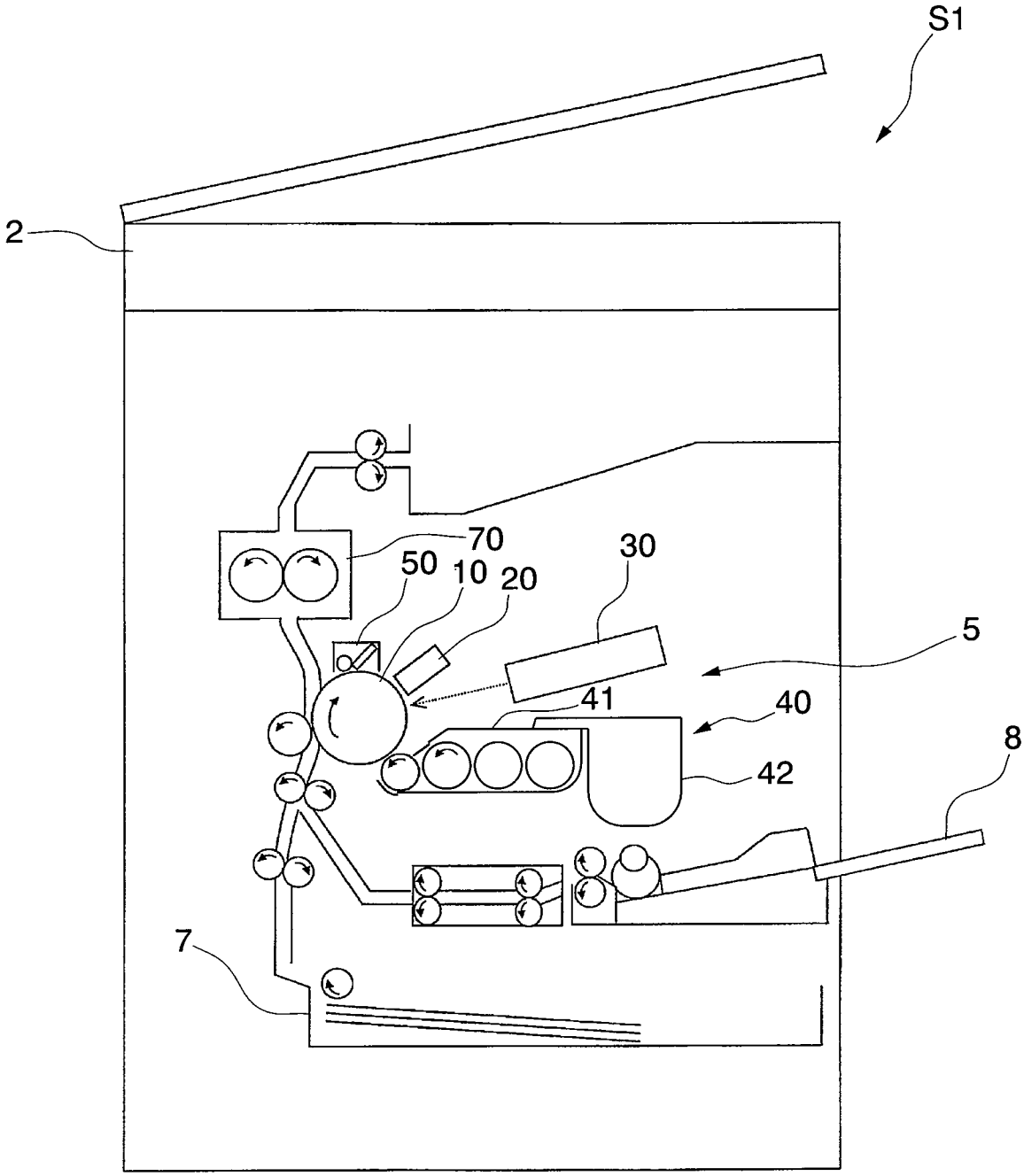
FIG. 2 is a schematic diagram of a configuration of the copier according to the embodiment.

FIG. 1 is a block diagram showing a functional configuration of a copier S1 (i.e., an image forming device) according to the present embodiment. FIG. 2 is a schematic diagram of a configuration of the copier S1.

As shown in FIG. 1, the copier S1 includes a display operating section 1, an image reading section 2, an image storage section 3, an image processing section 4, a printing section 5 and a control section 6.

In the present embodiment, the copier S1 use a two-component developing agent, in which magnetic powder is used as a carrier together with toner. The copier S1 performs so-called touchdown development, in which the developing section carrying the toner is provided facing to the photoreceptor.

The display operating section 1 is provided in the front of the device (not shown in FIG. 2) as an interface between a user and the copier S1. The display operating section 1 includes a touchscreen 1*a* and operation keys 1*b*.

The touchscreen 1*a* is a display panel in which a transparent sheet-like pressure sensor is provided on a display surface. The pressure sensor is, for example, a resistance-film type sensor. The touchscreen 1*a* displays information to be presented to the user and outputs operation signals in response to the user operation.

The operation keys 1*b* include operation keys (i.e., hardware keys) other than manual operation buttons displayed on the touchscreen 1*a*, which may include a power button and a copy start button. The operation key 1*b* outputs operation signals in response to the user operation.

The image reading section 2 reads, in response to a control command input through the control section 6, an image of original documents fed automatically by an automatic document feeder (ADF) or an image of an original document placed on a platen glass, with a line sensor and then converts the read data into image data of the original document. The image reading section 2 outputs the image data of the original document.

As shown in FIG. 2, the image reading section 2 is disposed in the upper side of the copier S1 and the display operating section 1 is disposed, for example, near the image reading section 2.

Referring again to FIG. 1, the image storage section 3 is a semiconductor memory or a hard disk device. The image storage section 3 stores the image data of the original document forwarded from the image reading section 2, in response to a control command input through the control section 6. The image storage section 3 reads and outputs the image data of the original document.

In response to a control command input through the control section 6, the image processing section 4 converts the image data of the original document forwarded from the image storage section 3 into image data formatted for printing and then outputs the converted data. The image processing section 4 optionally performs, as needed, image processing on the image data of the original document before converting the data into the image data formatted for printing.

The image processing section 4 includes a processing unit which performs data processing and a storage section which stores programs and parameters. The image processing section 4 optionally controls the printing section 5 under the control of the control section 6 as needed.

The printing section 5 prints (i.e., forms an image) on a sheet of recording paper fed from a paper cassette 7 or a paper tray 8 (see FIG. 2) in response to a control command input through the control section 6. The printing section 5 is disposed in a substantial center of the copier S1 as shown in FIG. 2.

The printing section 5 includes a photoreceptor drum (i.e., a photoreceptor) 10, a charging unit 20, a laser scanning unit 30, a developing unit 40, a cleaning unit 50 and a fixing device 70 as shown in FIG. 2.

The photoreceptor drum 10, having a cylindrical configuration, is provided to extend in the depth direction of FIG. 2. An electrostatic latent image and a toner image based on the electrostatic latent image is formed on a cylindrical surface of the photoreceptor drum 10.

The charging unit 20 is placed opposite the photoreceptor drum 10 so as to charge the cylindrical surface of the photoreceptor drum 10.

The laser scanning unit 30 is disposed above the photoreceptor drum 10 so as to scan the cylindrical surface of the photoreceptor drum 10 while irradiating the cylindrical surface with a laser beam based on the image data formatted for printing.

The cylindrical surface of the photoreceptor drum 10 is charged by the charging unit 20 and the charged cylindrical surface is scanned with the laser beam emitted by the laser scanning unit 30. In this manner, an electrostatic latent image based on the image data formatted for printing is formed on the cylindrical surface of the photoreceptor drum 10.

The developing unit 40 provides toner to the cylindrical surface of the photoreceptor drum 10 to develop an image based on the electrostatic latent image on the cylindrical surface of the photoreceptor drum 10. The developing unit 40 is placed facing to the photoreceptor drum 10.

Figure 3:
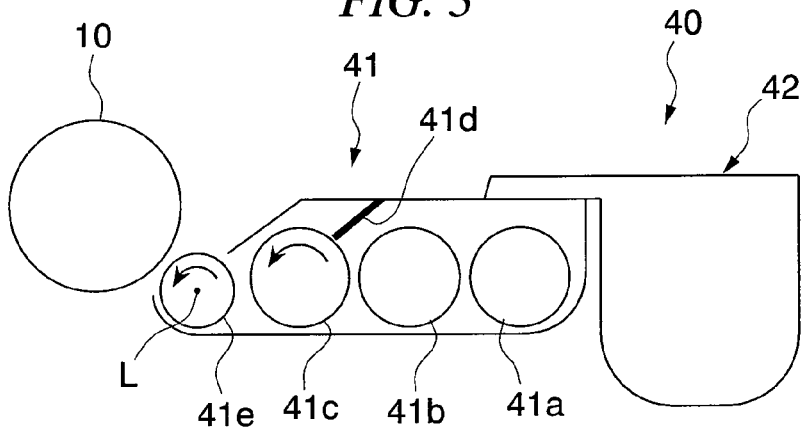
FIG. 3 is a schematic diagram of a photoreceptor drum and a developing unit provided in the copier according to the embodiment.

The developing unit 40 includes a developing system 41 (i.e., a case) and a container 42. FIG. 3 is a schematic diagram of the photoreceptor drum 10 and the developing unit 40.

As shown in FIG. 3, two spiral rollers 41*a* and 41*b*, a magnetic roller 41*c*, a control blade 41*d* and a developing roller 41*e* are provided in the developing system 41.

The two spiral rollers 41*a* and 41*b* mix the carrier contained in the developing system 41 with the toner supplied from the container 42.

The magnetic roller 41*c* includes a cylinder body made of a nonmagnetic material, and a plurality of magnets scattered inside of the cylinder body. The magnetic roller 41*c* forms a magnetic brush on the cylindrical surface thereof, by attracting carrier particles with attached toner thereon, by the magnets.

The control blade 41*d* is disposed apart from the magnetic rollers 41*c* by a predetermined distance so as to control the thickness of the magnetic brush.

The developing roller 41*e* rotates about a rotational axis L to receive the toner conveyed by the magnetic roller 41*c* and provides the received toner to the photoreceptor drum 10. The developing roller 41*e* is rotatably supported on the developing system 41 so as to be half-exposed from the developing system 41.

Figure 4:
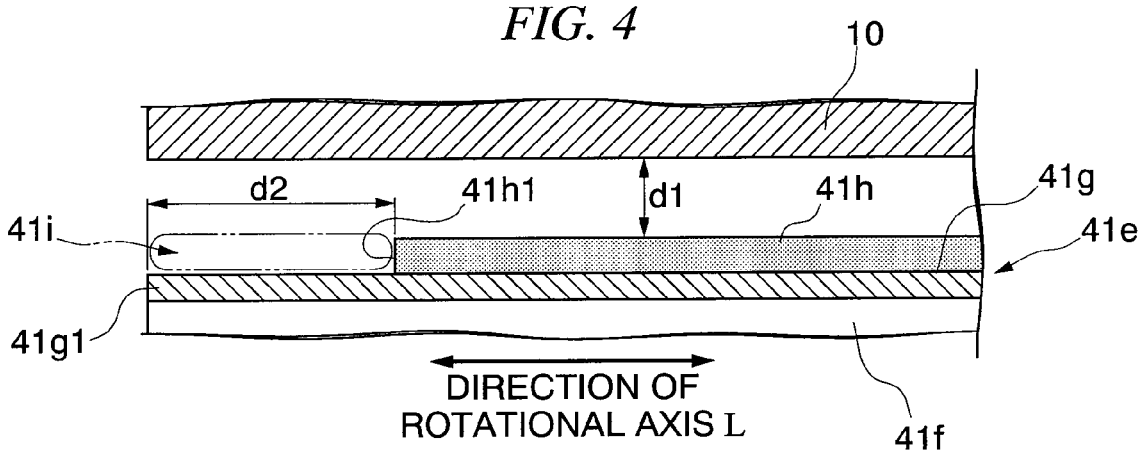
FIG. 4 is an enlarged sectional view of the developing roller provided in the copier according to the embodiment.

FIG. 4 is an enlarged sectional view of the developing roller 41*e*. In FIG. 4, an end of the developing roller 41*e* along the direction of the rotational axis L is enlarged. As shown in FIG. 4, the developing roller 41*e* includes a cylindrical core portion 41*f* made of aluminum (i.e., an electric conductor), an alumite layer 41*g* (i.e., a first resistive layer) which covers the cylindrical surface of the core portion 41*f*, and a silicone-modified urethane resin layer 41*h* (i.e., a second resistive layer) which covers the alumite layer 41*g* and has resistivity lower than that of the alumite layer 41*g* (any resin scattered with conductive fine-particles may be used, such as silicone-modified urethane scattered with carbon black particles). Moreover, by designing the device so that the electrostatic polarity of the low-resistance layer resulting from the friction with the carrier becomes the same polarity of the charged toner, an excessive charging of the toner resulting from the friction between the low-resistance layer and the toner can be prevented. Furthermore, since the silicone-modified urethane resin layer 41*h* has certain conductivity, the small amount of electrostatic charges caused by the friction with the toner does not accumulate on the silicone-modified urethane resin layer 41*h*. Accordingly, the electric field for toner thin-layer on the developing roller 41*e* can be stably formed without affected by such unintended charge accumulation. In addition, a sufficient toner image density can be stably achieved on the photoreceptor drum 10.

DC and AC power supplies are connected to the core portion 41*f*. The DC power supply produces a predetermined potential difference for toner transfer between the core portion 41*f* and the photoreceptor drum 10. The AC power supply applies AC voltage to increase developability.

The alumite layer 41*g* is formed to the thickness of, for example, 15 micrometers, and has a resistance value of $10^8$ to $10^{11}\Omega$ when voltage of 100V is applied thereto. The silicone-modified urethane resin layer 41*h* is formed to the thickness of, for example, 10 micrometers or less, and has a resistance value of $10^3$ to $10^5\Omega$ when voltage of 100V is applied thereto.

In the present embodiment, as shown in FIG. 4, the alumite layer 41*g* covers the entire cylindrical surface of the core portion 41*f*. The silicone-modified urethane resin layer 41*h* is provided such that an end 41*h*1 thereof is positioned further toward the center of the developing roller 41*e* in the direction of the rotational axis L than an end 41*g*1 of the alumite layer 41*g*.

That is, in the present embodiment, a space 41*i* is formed in an potential electric conduction path continued from the core portion 41*f* to the silicone-modified urethane resin layer 41*h* at a position between the end 41*g*1 of the alumite layer 41*g* and the end 41*h*1 of the silicone-modified urethane resin layer 41*h* along the rotational axis L direction.

The space 41*i* prevents leakage of electric current from the core portion 41*f* into the silicone-modified urethane resin layer 41*h*.

A distance d1 between the developing roller 41*e* and the photoreceptor drum 10 is determined such that an amount of electric current leaking from the developing roller 41*e* toward the photoreceptor drum 10 becomes smaller than a tolerance value. In this manner, when a distance d2 of the space 41*i* in the direction of the rotational axis L is longer than the distance d1, the leakage of electric current from the core portion 41*f* toward the silicone-modified urethane resin layer 41*h* can be controlled to be smaller than the tolerance value. With this configuration, the leakage of electric current from the developing roller 41*e* toward the photoreceptor drum 10 can be securely controlled to be smaller than the tolerance value reliably.

The container 42 contains the toner to be supplied to the developing system 41. The container 42 is connected to the developing system 41.

According to the thus-configured developing unit 40, the toner is supplied from the container 42 to the developing system 41. The supplied toner is mixed with the carrier by the spiral rollers 41*a* and 41*b*, and charged.

After the magnetic brush of the carrier is formed by the magnetic roller 41*c*, the toner mixed with the carrier is conveyed by the magnetic brush toward the developing roller 41*e*.

The toner conveyed by the magnetic brush is transferred to the developing roller 41*e* from the magnetic brush and supplied to the photoreceptor drum 10.

Here, in the developing unit 40 provided in the copier S1 of the present embodiment, an outermost layer of the developing roller 41*e* is the silicone-modified urethane resin layer 41*h* with electric-resistivity lower than that of alumite layer 41*g*. The charging polarity of the silicone-modified urethane resin layer 41*h* caused by friction charging with the carrier is the same polarity with the toner charging. Thus, a charging-up of the toner due to friction between the toner and the developing roller 41*e*, and charge accumulation on the silicone-modified urethane resin layer 41*h* are prevented.

In the developing unit 40 provided in the copier S1 of the present embodiment, a space 41*i* is formed in the potential electric conduction path continued from the core portion 41*f* to the silicone-modified urethane resin layer 41*h* at a position between an end 41*g*1 of the alumite layer 41*g* and an end 41*h*1 of the silicone-modified urethane resin layer 41*h* along the rotational axis L direction. The space 41*i* prevents leakage of electric current from the core portion 41*f* into the silicone-modified urethane resin layer 41*h*. With this configuration, the amount of electric current leaking from the core portion 41*f* to the silicone-modified urethane resin layer 41*h* can be made smaller than the tolerance value.

Accordingly, in the developing unit 40 provided in the copier S1 of the present embodiment, defective toner transfer to the photoreceptor drum 10 due to excessive charging of the toner can be prevented. At the same time, leakage of electric current from between the developing roller 41*e* and the photoreceptor drum 10 can be prevented.

Figure 5:
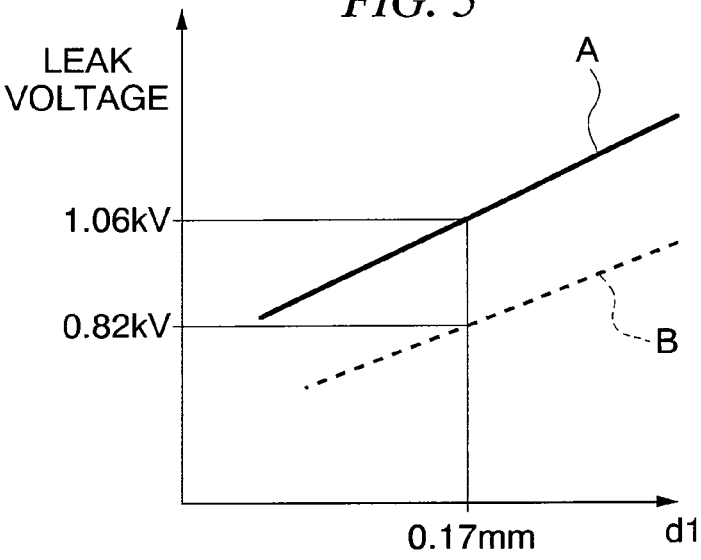
FIG. 5 is a graph showing a relationship between leak voltage and a distance between a developing roller and a photoreceptor drum in a developing unit provided in the copier according to the embodiment described above, and in a developing unit including a developing roller in which the entire alumite layer is covered with a silicone-modified urethane resin layer.

FIG. 5 is a graph showing a relationship between the distance d1 (i.e., the distance between the developing roller and the photoreceptor drum) and the leak voltage (i.e., the voltage at which excessive current leakage occur over the tolerance value) in the developing unit 40 provided in the copier S1 of the present embodiment and in a developing unit including a developing roller in which the entire alumite layer is covered with a silicone-modified urethane resin layer (i.e., the space 41*i* is not formed therebetween). In FIG. 5, the graph A corresponds to the developing unit 40 provided in the copier S1 of the present embodiment and the graph B corresponds to the developing unit including a developing roller in which the entire alumite layer is covered with a silicone-modified urethane resin layer.

In the experiment shown in FIG. 5, the configurations of the copiers are as follows: photoreceptor drum diameter=30 mm; developing roller diameter=16 mm; magnetic roller diameter=20 mm; the distance d1 between the developing roller and the photoreceptor drum=0.17 mm; the distance between the developing roller and the magnetic roller=0.25 mm; dark voltage of the photoreceptor=350 V; light voltage of the photoreceptor=20 V. The voltage applied to the developing roller is as follows: Vpp=2.7 kV, frequency (Vf)=2.7 kHz, Vdc=100V and Duty=40%. The voltage applied to the magnetic roller is as follows: Vpp=300V, frequency (Vf)=2.7 kHz, and Duty=60%. The rim speed of the photoreceptor drum is 100 mm/sec. The rim speed of the developing roller is 150 mm/sec. The rim speed of the magnetic roller is 225 mm/sec.

In the copier S1 of the present embodiment, the length d2 of the space 41*i* is 0.3 mm.

In the experiment, the toner electric charge amount is 15 μC/g, as measured by a QM meter (Trek, Inc., Model 210HS). It is preferable to use a toner electric charge amount in the range of approximately 10-20 μC/g.

If the electric charge amount smaller than the preferable range was used, toner would come off the magnetic brush and dispersed to the surrounding region, while the electric charge amount larger than the preferable range was used, the efficiency of the toner thin-layer formation would become lower.

For the carrier, ferrite core surface was coated with resin to obtain a weight-average particle diameter of 45 μm, saturation magnetization of 50 emu/g (as measured using VSM-P7, TOEI, Inc.), and a magnetic field of 79.6 kA/m (as measured using 1 kOe).

It is preferable to use the carrier with a weight-average particle diameter in the range of 30-60 μm. If the carrier diameter is smaller than the preferable range, the liquidity of the developing agent becomes poor, and it becomes hard to obtain an even distribution at the time of toner-carrier mixing. If the carrier diameter is larger than the preferable range, the toner thin-layer on the developing roller may not be formed dense enough, possibly resulting in uneven picture formation.

Moreover, it is preferable to use carrier having the saturation magnetization of 35-90 emu/g. When the carrier saturation magnetization is lower than 35 emu/g, a notable problem in carrier jumping occurs. When the carrier saturation magnetization is higher than 90 emu/g, the magnetic brush density becomes insufficient, resulting in inability to form an even toner thin-layer. The carrier is not limited to ferrite-core. Resin carrier with dispersed magnetized particles may also be used.

As shown in FIG. 5, the leak voltage is 1.06 kV when d1 is 0.17 mm in the developing unit 40 provided in the copier S1 of the present embodiment while the leak voltage is 0.82 kV when d1 is 0.17 mm in the developing roller in which the entire alumite layer is covered with a silicone-modified urethane resin layer.

As a result, it was found that leakage of electric current from the developing roller to the photoreceptor drum can be prevented in the developing unit 40 provided in the copier S1 of the present embodiment.

Referring again to FIG. 2, the cleaning unit 50, placed opposite the photoreceptor drum 10, removes the toner remaining on the photoreceptor drum 10 after the toner image is transferred from the photoreceptor drum 10 to the recording paper.

The fixing device 70, placed in the downstream of the developing unit 40 on the conveying path of the recording paper, fixes the toner to the recording paper by applying heat and pressure.

In the thus-configured printing section 5, the surface of the photoreceptor drum 10 is charged by the charging unit 20. An electrostatic latent image is formed on the photoreceptor drum 10 when the charged photoreceptor drum 10 is irradiated with the laser beam by the laser scanning unit 30. Then, the electrostatic latent image is developed by the developing unit 40 and the developed toner image is transferred to the recording paper. The toner is fixed to the recording paper by the fixing device 70. Through the above process, the printing is performed.

Referring again to FIG. 1, the control section 6 controls the entire copier S1 according to the present embodiment. The control section 6 is electrically connected to the display operating section 1, the image reading section 2, the image storage section 3, the image processing section 4 and the printing section 5.

In the thus-configured copier S1, image data of an original document placed in the image reading section 2 is read under the control of the control section 6 in response to the user operation in the display operating section 1. The read image data is stored in the image storage section 3. The image data stored in the image storage section 3 is converted into the image data formatted for printing in the image processing section 4, and is input to the printing section 5.

In the printing section 5, an image is formed on the printing paper based on the image data formatted for printing input from the image processing section 4. The printing paper with the image formed thereon is ejected to the exterior of the copier S1 as a printed matter.

Although the embodiment of the present invention has been described with reference to the drawings, the invention is not limited thereto. Any modifications can be made to the invention without departing from the spirit and scope of the invention.

For example, in the present embodiment, a copier has been illustrated as an image forming device according to the invention.

The image forming device, however, may alternatively be a facsimile machine or a composite machine.

The invention may also be applied to a copier with a so-called tandem system in which photoreceptor drums 10 are provided for each color.

The image forming device according to the invention may also be applied to a copier in which a toner image developed on a photoreceptor drum is once transferred to an intermediate transfer body and then transferred to a recording paper.

In the embodiment described above, the core portion 41*f* of the developing roller 41*e* is made of aluminum.

However, the invention is not limited to the described configuration and the core portion 41*f* may alternatively be made of other electric conductors such as copper.

In the embodiment described above, the first resistive layer is the alumite layer 41*g* and the second resistive layer is the silicone-modified urethane resin layer 41*h*.

However, the invention is not limited to the described configuration and it suffices that the first resistive layer is made of a material with relatively higher resistivity and the second resistive layer is made of a material with relatively lower resistivity.

For example, the second resistive layer is not necessarily made of silicone-modified urethane and may alternatively be made of a material which contains silicone-modified urethane.

In the embodiment described above, the space 41*i* is provided as a current leakage control member for preventing current leakage from the core portion 41*f* toward the silicone-modified urethane resin layer 41*h*.

Figure 6:
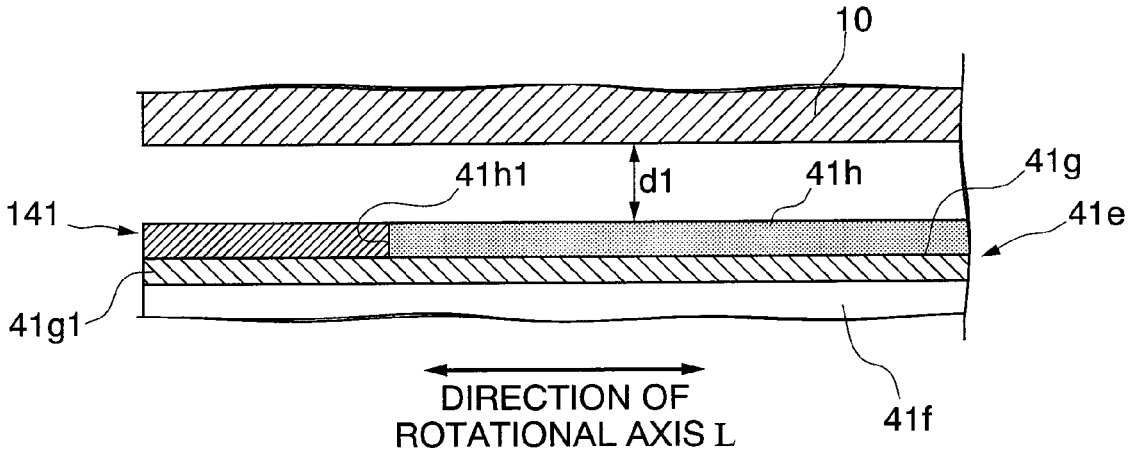
FIG. 6 is an enlarged sectional view of a developing roller provided in a copier according to a modified example of the embodiment of the present invention.

However, the invention is not limited to the described configuration, and a current leakage control layer 141 made of a material that prevents leakage of electric current from the core portion 41*f* toward the silicone-modified urethane resin layer 41*h* may be provided in place of the space 41*i* (see FIG. 6).

In the embodiment described above, the space 41*i* is formed on the surface of the alumite layer 41*g* (i.e., in the side of the silicone-modified urethane resin layer 41*h*).

Figure 7:
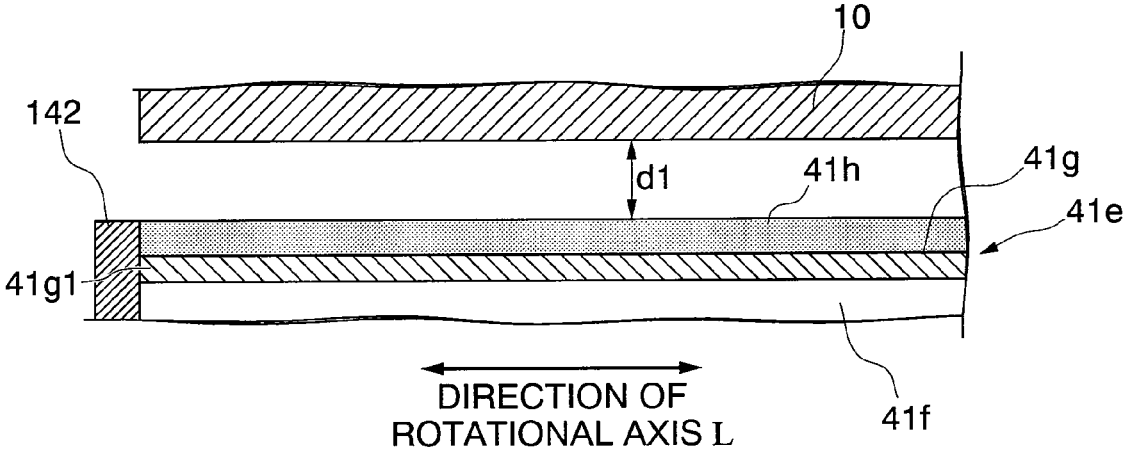
FIG. 7 is an enlarged sectional view of a developing roller provided in a copier according to another modified example of the embodiment of the present invention.

However, the invention is not limited to the described configuration. For example, if the current leakage control layer is provided in place of the space 41*i* as described above, the entire end of the core portion 41*f* may be formed as a current leakage control layer 142 (see FIG. 7).

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A developing unit comprising a developing roller which rotates about a rotational axis to supply toner to a photoreceptor, the developing roller including:

a cylindrical core portion which includes an electric conductor;

a first resistive layer which covers a cylindrical surface of the core portion;

a second resistive layer which covers the first resistive layer, and has electric-resistivity lower than that of the first resistive layer; and a current leakage control member which prevents leakage of electric current from the core portion toward the second resistive layer through an end of the developing roller along a direction of the rotational axis.

2. A developing unit according to claim 1, wherein the current leakage control member is an end of the second resistive layer which is arranged so as to maintain a first distance along the direction of the rotational axis from an end of the first resistive layer.

3. A developing unit according to claim 2, wherein the first distance is longer than a second distance between the surface of the second resistive layer and the photoreceptor.

4. A developing unit according to claim 1, wherein the current leakage control member is a current leakage control layer provided between an end of the first resistive layer and an end of the second resistive layer along the direction of the rotational axis.

5. A developing unit according to claim 1, wherein the current leakage control member is a current leakage control layer provided at an end of the core portion along the direction of the rotational axis.

6. A developing unit according to claim 1, wherein the first resistive layer contains alumite and the second resistive layer contains silicone-modified urethane.

7. An image forming device, comprising the developing unit according to claim 1, wherein the developing unit develops an electrostatic latent image formed on a photoreceptor with toner supplied to the photoreceptor.

* * * * *